United States Patent [19]

Keller

[11] 4,427,722

[45] Jan. 24, 1984

[54] APPARATUS FOR APPLYING A CONTROLLED LAYER OF A SATURANT OR A COATING VIA A FREE-FALLING VERTICAL CURTAIN

[75] Inventor: Martin B. Keller, Hudson Falls, N.Y.

[73] Assignee: Sandy Hill Corporation, Hudson Falls, N.Y.

[21] Appl. No.: 393,700

[22] Filed: Jun. 30, 1982

[51] Int. Cl.[3] ..... B05D 1/30

[52] U.S. Cl. ..... 427/420; 427/299; 118/407; 118/410; 118/DIG. 4; 68/62; 68/200

[58] Field of Search ..... 427/264, 275, 299, 326, 427/411, 420; 118/44, 412, 411, 50, 407, DIG. 4; 68/183, 200, 62

[56] References Cited

U.S. PATENT DOCUMENTS

| | | | |
|---|---|---|---|
| 3,067,060 | 12/1962 | Glaus | 427/420 |
| 3,205,089 | 9/1965 | Kinzelman | 427/420 |
| 3,242,003 | 3/1966 | Brown | 427/420 |
| 3,991,236 | 11/1976 | Fleissner | 427/420 |

*Primary Examiner*—Shrive P. Beck

*Attorney, Agent, or Firm*—Ross, Ross & Flavin

[57] ABSTRACT

Apparatus for coating a travelling web with at least one layer of a liquid coating composition, such as a binder, as the web is moved along a path through a coating zone by way of a formation at the coating zone of a free-falling vertical curtain which extends transversely of the path of travel and impinges the travelling web to deposit the coating thereon. A lip is provided in cooperation with an air pressure chamber so as to control the discharge of the binder onto the slide or face of an inclined wall and thence onto the web. The lip is adjusted uniformly across the machine width with a mechanical jack arrangement and it is also variably adjusted laterally of the machine width by means of spaced microjacks so as to permit the discharge of variable amounts of the composition across the machine in accordance with the lip opening set by the respective microjacks.

2 Claims, 2 Drawing Figures

APPARATUS FOR APPLYING A CONTROLLED LAYER OF A SATURANT OR A COATING VIA A FREE-FALLING VERTICAL CURTAIN

This invention is directed to a web saturator or coater which accepts a web moving therepast and saturates or coats same before its passage onto another work operation such as a drying procedure.

BACKGROUND OF THE INVENTION

The invention relates to an apparatus for and method of saturating or coating a travelling web of material by means of a controlled curtain of the saturant or coating.

The travelling web is treated by the controlled cascading of the saturant over an inclined slideway and applying same in the form of a free-falling vertical curtain of the saturant which impinges onto the travelling web so as to form a layer thereupon and/or to saturate therethrough, according to the particular characteristics of the saturant and/or of the web, and/or the exploitation of various suction devices according to the desired characteristics of the end product.

The apparatus may be used singly to allow a single layer of the coating, such as a binder, to be added to the travelling web, or a plurality thereof may be used in tandem to allow a plurality of seriatim layers of coating to be added thereto. And if desired, the apparatus may be used cooperantly with a series of suction or vacuum devices for purposes of more precisely conditioning the web by a progressive series of operations applying varying degrees of negative pressure.

SUMMARY OF THE INVENTION

The primary object of the invention is to provide a method of saturating or coating a travelling web with a layer or layers of an appropriate liquid composition such as a binder by the steps of moving the web along a path through a work zone and forming at the work zone a free-falling vertical curtain of the saturant or coating extending transversely of the web path and impinging same on the travelling web.

In the preferred embodiment, the apparatus comprises means for forming a free-falling vertical curtain inclusive of a well or reservoir or cavity for containing the saturating or coating composition and flowing same outwardly therefrom through a pressurized headbox, over a dam on the downstream side of the well and along an inclined slide through a variable slice disposed adjacent the slide, with the slide terminating in a lip along its lowermost edge from whence the liquid falls by gravity as a vertically disposed curtain onto the travelling web therebelow.

An air pressure chamber is provided to permit the discharge of a controlled increased amount of binder to the web.

Additionally, the apparatus is provided with a lip which can be adjusted uniformly across the machine width and relative to the inclined slide and with a mechanical jack arrangement located on top of the air cap for controlling the size of the defined slice between lip and slide.

It can also be adjusted by means of a plurality of microjacks positioned at intervals across the machine width so as to allow the discharge of a variable amount of binder in accordance with the set lip opening at the different intervals along the machine width, wherefor a relatively heavy or light discharge of the binder can be made centrally of the web and/or at one side of the median line thereof and/or at a side edge of the web, all as may be desired.

Advantageously, means may be provided for varying the vertical spacing between the terminus of the slide lip and web moving along the path, thereby regulating the curtain height, the distance over which free fall occurs depending on the nature of the specific application involved and the characteristics of the particular liquid composition employed. In selecting any optimum height for any particular application, a chief criterion is to make the height as small as practical while yet affording a desired result. The greater the curtain height, the more susceptible it is to being affected by such as ambient air currents which may create curtain fluctuations with unwanted attendant variations in the deposited layer on the web.

A vertical height has to be selected which will satisfy the dictate that the free-falling curtain will have such momentum upon impingement that it will penetrate any existing air barrier or at least will displace it so as to permit the desideratum of adhering to the web or penetrating therethrough. Any air barrier so encountered may be found to vary with such different factors as the surface character of the work being treated, and the velocity of the work as it is advanced relative to the apparatus.

The law of momentum, as the product of velocity and mass, teaches that, if the rate of liquid flow is reduced, while the web velocity of the web remains constant, the height of free-fall must, normally, be increased in order to increase the impingement velocity and to give the free-falling curtain such adequacy of momentum as to penetrate the air barrier without disruption.

BRIEF DESCRIPTION OF THE DRAWINGS

The accompanying drawings will serve to illustrate the method and apparatus of the present invention, and therein.

DETAILED DESCRIPTION

Figures 1, 2:
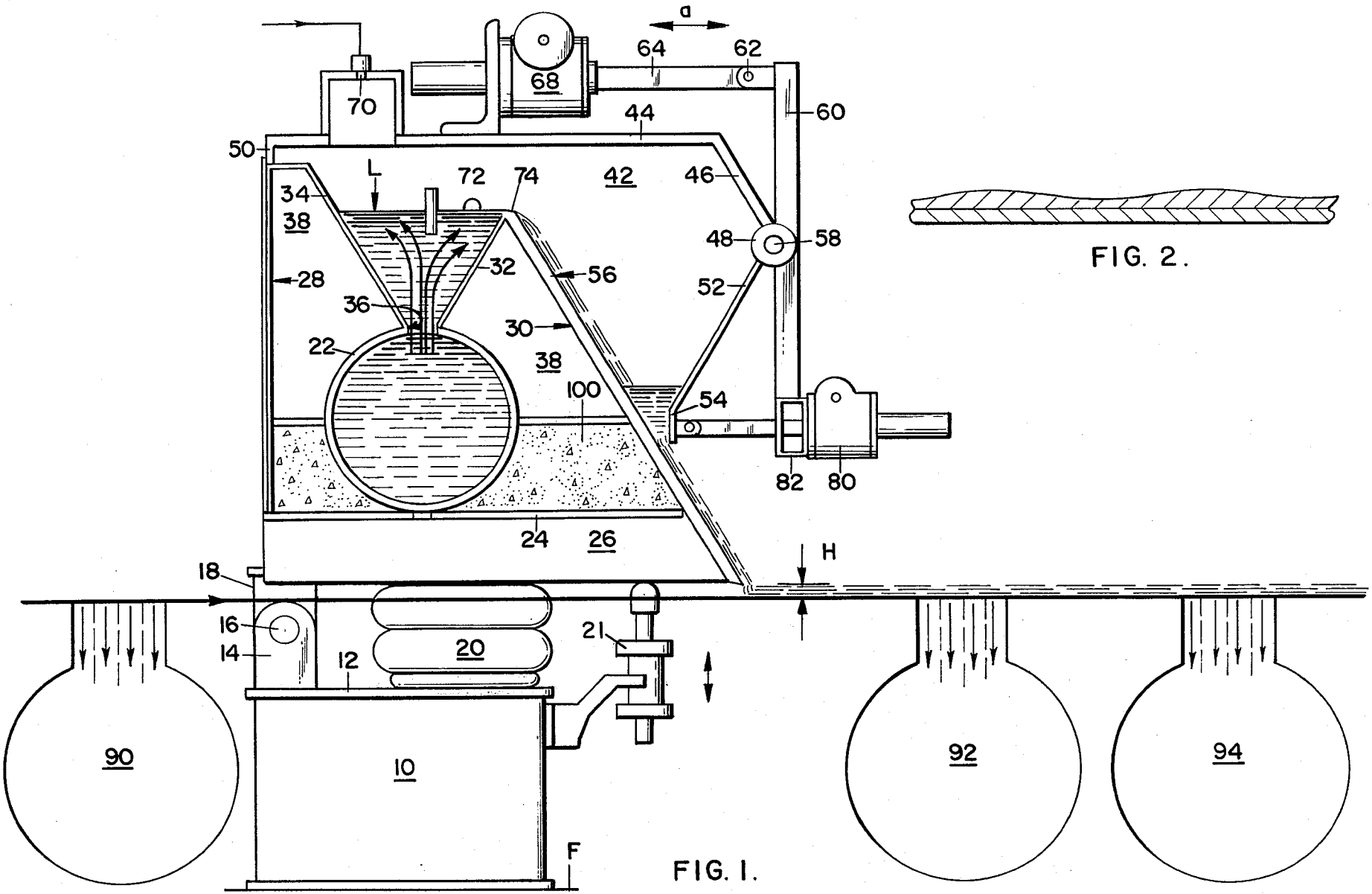
FIG. 1 is a sectional elevational view of the apparatus of the invention.
FIG. 2 is a transverse sectional view through a typical treated web showing the effect of varying the amount of deposition of binder thereon.

The apparatus is shown as including a pair of spaced vertically-extending stands 10, each being footed on a mill flooring F on opposite sides of a travelling wire or belt B upon which a web or work W is moved past and below the to-be-described operating mechanism of the apparatus.

A clevis 14 extends upwardly from each stand and through each of which a pin 16 extends for pivotally supporting a foot 18 at both the tending and drive sides of the machine.

Also supported upwardly vertically above a respective stand 10 on each side of the apparatus is an airride 20 connected by means (not shown) to a valved air source (not shown) wherewith pressurized air may be charged to or released from the airrides for purposes later to be referred to.

An adjustable jacking mechanism 21 may be provided on each stand for purposes of elevating the applicator box about to be described.

Spaced upwardly from stands 10 and from belt B and web W is a horizontally-extending header 22 which extends centrally through an applicator box defined by a horizontally-extending bottom wall 24 supported by a lower frame 26, a transverse vertically-extending rear wall 28, an inclined front wall or slide 30, and inwardly converging front and rear top walls 32 and 34 respectively, which front and rear top walls are connected at their lower extremities astride opposite sides of a slot 36 extending through the topmost portion of header 22. Opposite side walls 38 at opposite sides of the applicator box complete the enclosure, all of the walls being interjoined in conventional manner to define a unitary construction.

If desired, slot 36 through the top side of header 22 may be substituted for a plurality of spaced apertures.

Header 22 extends outboard of the enclosure through one of the side walls and will be fed from an outside source of material (not shown) in this conventional so-called side inlet manner.

By the means thus far described, the enclosure may be raised or lowered upon pins 16 by means of the pressurizing or releasing of airrides 20 so as to allow ready access to the transporting or travelling wire B for threading or other purposes as well as to allow the varying of the vertical distance between the edge of the lip at the lower terminus of the slide and the travelling wire B.

Upwardly of the applicator box a sealed pressure chamber is defined by opposite side walls 42, extending upwardly from and connecting with respective side wlls 38, a cover 44 extending transversely of the apparatus and having a forward portion 46 terminating at a pivot point 48 and a rearward portion 50 connecting with rear top wall 34, and a lower wall 52 extending transversely of the apparatus and extending between pivot point 48 and a downwardly facing lip 54.

The inside wall of a lip 54 has a transversely-extending sealing lip 56 so as to effectively seal off the pressure chamber.

Pivot 48 mounts a pivot pin 58 by means of which lower wall 52 may be pivotally moved so that lip 54 is moved toward or away from the outer surface of inclined front wall 30 defining a slide 56.

Pivot 48 is supported by a pair of vertically depending beams 60 extending downwardly from and pivoted at 62 from the respective of a pair of horizontally extending posts 64 which project outwardly from and are moved in fore and aft directions as indicated by arrow a by respective motors 68 mounted on cover 44.

Selective operation of motors 68 drives the posts 64 forwardly or rearwardly and controls the movement of lip 54 toward and away from slide 56 and hence controls the general dimension of the slice therebetween for the obvious control of the flow of material passing therethrough.

Pressurized air is introduced to the gas pressure chamber through a manhole 70 and a level control blow hole 72 allows maintaining a stock level L in the housing under the pressure as applied by compressed air through the manhole. The level L is maintained so as to just submerge the dam or weir 74 defined by the apex of front wall 30 and front top wall 32 over which liquid flows from upwardly from header 22 through slot 36 (or apertures) into and out of the well thereabove and thence over the dam and downwardly along the slide.

The usual tending side and distant side deckles (not shown are disposed on each side of front wall 36, which deckles may be adjusted in inboard and outboard directions for the known function of varying the work area width.

The height of the free-falling curtain, that is, the vertical distance from lip to web over which free fall occurs can be varied to accommodate to the nature of a specific application and the particular characteristics of the liquid composition therein employed, but preferentially, the height will be as small as is practical. The higher the curtain, the greater the opportunity for ambient air currents to take their toll in curtain fluctuations and resultant variations in the manner in which the liquid contacts the web.

Under typical operating conditions, the height of the free-falling curtain will be in the range of $\frac{1}{4}''$ to 3/4" but operations at smaller or greater heights are within the letter and spirit hereof.

The coating or saturant is continuously fed as a curtain at a rate at least as great as it is removed by the moving web, and in order to maintain the lip of the slide is positioned in close proximity to the surface of the moving web.

The layer can be oriented in any desired manner with wide variation permissible with respect to thickness and/or viscosity of the particular liquid coating composition.

The space between lip and slide is such that the stock receiving chamber is closed so that air pressure may be built up therein by the air inlet.

It is to be appreciated that stock in this chamber may be maintained under pressure merely by a suitable stock flow pump and without the use of air under pressure as shown.

In either case the sealing means is effective to maintain such pressure.

The sealing means will comprise a rubber sealing strip.

To increase the mass, certain interior space 100 within the enclosure may be filled with concrete.

As shown schematically, the applicator can be used in combination with a series of three suction or vacuum boxes 90, 93 and 94, wherein suction box 90 is disposed in advance of the applicator operating area for use in conditioning the web to attain an optimum or minimum water content before the initiation of the saturation step, wherein suction box 92 is disposed in the applicator operating area for use in applying a low degree of vacuum so as to draw the saturant through the web and removing any excess thereof, and wherein suction box 94 is disposed outboard of the applicator operating area for use in fine-tuning with minute or discrete vacuum control so as to allow a retention of the precise desired amount of saturant on the web or sheet.

The invention is specifically illustrated with no reference to any other particular type of application, although it is to be understood that it offers opportunity for wide application, with utilization to advantage in numerous fields, wherein it is desired to effect application of a superposed layer of liquid coating composition or of a liquid saturant.

It will be appreciated that the invention is not limited to the particular construction of the exemplary embodiment illustrated but includes variants and equivalents within the spirit and the scope of the invention as defined by the claims.

The invention is claimed as follows:

1. A method of applying a layer of a saturating substance upon a travelling web consisting of the steps:

a. transporting the web along a horizontal path below a hopper, b. feeding a charge of the saturating substance in the hopper upwardly over a hopper dam and onto a downwardly inclined slide where adjacent edge means defines a seal producing a pressurized chamber containing the charge of saturating substance which overflows the dam opening, c. adjusting the edge means with respect to the slide for closing off the pressure chamber for the buildup of pressure therewithin and for controlling the amount of saturating substance allowed to escape from the pressurized chamber and thereby controlling the amount of saturating substance allowed to proceed further down the slide where at the termination of the slide the saturating substance freefalls onto the traveling web therebelow.

2. In a machine for applying a liquid coating to a travelling web, the combination of, means for translating the web to be coated along a predetermined horizontal path relative to and below the machine, coating liquid means extending transversely across the path in spaced overlying relation thereto and including:

an enclosed hopper, a hopper dam upwardly of the hopper and within the enclosure, means for forcing the coating liquid outwardly of the hopper and over the dam, a downwardly inclined slide disposed adjacent to the dam for accommodating the coating liquid forced over the dam, edge means defining a seal to produce jointly with the enclosure a pressurized chamber and being adjustable with respect to the slide for closing off the pressure chamber for air pressure buildup therewithin and for controlling the amount of coating material allowed to escape from the chamber and to proceed down the slide where at its termination the coating material freefalls onto the web passing beneath the coating liquid means.

* * * * *